US008834103B2

(12) United States Patent
Hirokawa et al.

(10) Patent No.: US 8,834,103 B2
(45) Date of Patent: Sep. 16, 2014

(54) STRUCTURE FOR MOUNTING BETWEEN ROTATION SHAFT AND LEVER, METHOD FOR MOUNTING BETWEEN ROTATION SHAFT AND LEVER, AND FLUID MACHINE

(75) Inventors: Kazuharu Hirokawa, Takasago (JP); Eiichi Tsutsumi, Takasago (JP); Masaru Nishikatsu, Kobe (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 663 days.

(21) Appl. No.: 13/128,148

(22) PCT Filed: Sep. 3, 2009

(86) PCT No.: PCT/JP2009/004356

§ 371 (c)(1),
(2), (4) Date: May 6, 2011

(87) PCT Pub. No.: WO2010/097850

PCT Pub. Date: Sep. 2, 2010

(65) Prior Publication Data

US 2011/0211941 A1 Sep. 1, 2011

(30) Foreign Application Priority Data

Feb. 24, 2009 (JP) ..... 2009-040972

(51) Int. Cl.
*F01D 9/02* (2006.01)
*F04D 29/56* (2006.01)

(52) U.S. Cl.
CPC ..... *F04D 29/563* (2013.01)
USPC ..... 415/160; 415/162

(58) Field of Classification Search
CPC ..... F01D 17/162
USPC ..... 415/160, 162, 163, 164, 165
See application file for complete search history.

(56) References Cited

U.S. PATENT DOCUMENTS 4,307,994 A * 12/1981 Brewer ..... 415/160
4,585,390 A * 4/1986 Pirtle et al. ..... 415/160

(Continued)

FOREIGN PATENT DOCUMENTS

JP 30-010696 A 7/1955
JP 44-014815 Y1 6/1969

(Continued)

OTHER PUBLICATIONS

International Search Report of PCT/JP2009/004356, mailing date Oct. 13, 2009.

(Continued)

*Primary Examiner* — Ninh H Nguyen
(74) *Attorney, Agent, or Firm* — Westerman, Hattori, Daniels & Adrian, LLP

(57) ABSTRACT

A structure that mounts to a rotation shaft a lever that causes this rotation shaft to rotate, including a plurality of engaging members that are provided in the lever so as to be offset from the center axis of the rotation shaft, and that are capable of advancing toward and retracting from the outer periphery of the rotation shaft, and a plurality of abutted faces that are provided on the outer periphery of the rotation shaft so that the distal end faces of the plurality of engaging members respectively make contact, in which, when at least one of the engaging members and the abutted face that corresponds to that engaging member are in contact, relative rotation of the rotation shaft about the axis thereof in one direction with respect to the lever is restricted, and when another engaging member and another abutted face corresponding to the engaging member are in contact, relative rotation of the rotation shaft about the axis thereof in the other direction with respect to the lever is restricted.

9 Claims, 11 Drawing Sheets

(56) References Cited

U.S. PATENT DOCUMENTS

| | | | | | |
|---|---|---|---|---|---|
| 5,061,152 | A | * | 10/1991 | Marey | 415/150 |
| 5,492,446 | A | * | 2/1996 | Hawkins et al. | 415/160 |
| 6,077,013 | A | * | 6/2000 | Yamamoto et al. | 411/386 |

FOREIGN PATENT DOCUMENTS

| | | | |
|---|---|---|---|
| JP | 53-117364 | U | 9/1978 |
| JP | 56-000557 | U | 1/1981 |
| JP | 58-180704 | A | 10/1983 |
| JP | 61-204996 | U | 12/1986 |
| JP | 2000-320498 | A | 11/2000 |
| JP | 2003-227495 | A | 8/2003 |
| JP | 2004-076648 | A | 3/2004 |

OTHER PUBLICATIONS

Written Opinion of PCT/JP2009/004356, mailing date Oct. 13, 2009. W/ English summary.

* cited by examiner

STRUCTURE FOR MOUNTING BETWEEN ROTATION SHAFT AND LEVER, METHOD FOR MOUNTING BETWEEN ROTATION SHAFT AND LEVER, AND FLUID MACHINE

TECHNICAL FIELD

The present invention relates to a mounting structure that mounts to a rotation shaft a lever that causes this rotation shaft to rotate, a method for mounting, and a fluid machine that is provided with the mounting structure.

Priority is claimed on Japanese Patent Application No. 2009-040972, filed Feb. 24, 2009, the content of which is incorporated herein by reference.

BACKGROUND ART

In a fluid machine that has stator vanes and rotor vanes such as a turbine or compressor, there are cases of applying a variable stator vane whose angle can be adjusted in order to adjust the output. Such a variable stator vane is mounted to the inner circumferential surface side of a casing so as to be rotatable about its center axis. At the base end of the variable stator vane, a rotation shaft extends toward the outer circumferential side so as to be coaxial with the center axis of the variable stator vane, and the rotation shaft projects to the outer circumferential side of the casing. Then, a lever is mounted to the distal end portion of the rotation shaft that is projected to the outer circumferential side of the casing, and by turning the lever with a driving apparatus that is mounted to the outer portion of the casing, the angle of the variable stator vane is adjusted, and the variable stator vane is maintained at the adjusted angle.

Here, the angle of the variable stator vane is adjusted by the rotation angle of the lever as described above. For that reason, the lever must be accurately mounted so as to attain a predetermined angle with respect to the variable stator vane and the rotation shaft, and it must be firmly mounted and resist the torque that acts by the pressure that the variable stator vane receives from the fluid that flows around the variable stator vane during operation. Conventionally, the mounting structure 100 as shown in FIG. 16 and FIG. 17 has been adopted for the mounting structure of the rotation shaft and the lever. That is, these drawings disclose a structure in which fitting holes that are in communication are formed in the rotation shaft 90 and the lever 91 that the rotation shaft 90 in which the rotation shaft 90 is fitted, and a key 103 that in cross section has a C shape is press fitted into the fitting holes 101 and 102 that are in communication, while causing the cross-sectional shape to resiliently deform. In such a structure, by inserting the aforementioned key 103 into the fitting holes 101 and 102, the mutual fitting holes 101 and 102 are fixed in an aligned state, and thereby the lever 91 is fixed at a predetermined angle with respect to the rotation shaft 90. Also, they are firmly fixed to each other by the key 103 being press fitted while resiliently deforming its cross-sectional shape.

Also, as a different type of mounting structure, there is known one that provides a tapered protrusion on the rotation shaft, and forms on the other side a tapered groove in a manner allowing insertion of the protrusion, and by tightening both by a tightening mechanism that is provided on the rotation shaft, presses the protrusion and the tapered groove against each other (for example, refer to patent Documents 1 and 2).

CITATION LIST

Patent Documents

[Patent Document 1] Japanese Unexamined Patent Application No. 2000-320498

[Patent Document 2] Japanese Unexamined Patent Application No. 2003-227495

SUMMARY OF THE INVENTION

Problems to be Solved by the Invention

However, in the mounting structure that is shown in FIG. 16 and FIG. 17, in order firmly fix the rotation shaft 90 and the lever 91, it is necessary to press fit the key 103 while resiliently deforming the cross-sectional shape thereof, and that work is extremely difficult. Also, if the fitting holes 101 and 102 are not provided with high accuracy in the rotation shaft 90 and the lever 91, respectively, gaps may arise with the key 103 that has been press fitted, leading to the problem of accurate positioning no longer being possible. Moreover, shearing force acts on the fixing key 103 due to the torque that acts from the rotation shaft 90 to the lever 91. For that reason, it is necessary to secure the cross section of the fixing key 103 to be capable of enduring that shearing force. However, when attempting to secure a sufficient cross section, there has been the problem of the press fitting by resilient deformation becoming further difficult.

Also, in the mounting structure of Patent Documents 1 and 2, the rotation shaft and the lever are integrated. For that reason, it is necessary to form the tapered protrusion and tapered groove that mutually fit, and so there has been the problem of its manufacture becoming complicated. Also, because the structure is complicated, there are such problems as ensuring the mutual positioning accuracy being difficult, and the size of each member being increased in order to ensure the required strength.

The present invention is achieved in view of the aforementioned circumstances, and has as its object to provide a mounting structure for a rotation shaft and a lever that with a simple constitution is capable of firmly fixing the lever to the rotation shaft while accurately positioning the lever to the rotation shaft, a method for mounting the lever to the rotation shaft, and a fluid machine that is provided with the mounting structure.

Means for Solving the Problems

In order to solve the aforementioned problems, the present invention is a structure that mounts to a rotation shaft a lever that causes this rotation shaft to rotate, provided with a plurality of engaging members that are mounted to the lever so as to be offset from the center axis of the rotation shaft, and that are capable of advancing toward and retracting from the outer periphery of the rotation shaft, and a plurality of abutted faces that are provided on the outer periphery of the rotation shaft so that the distal end faces of the plurality of engaging members respectively make contact, in which when at least one of the engaging members and the abutted face that corresponds to that engaging member are in contact, relative rotation of the rotation shaft about the axis thereof in one direction with respect to the lever is restricted, and when another engaging member and another abutted face corresponding to the engaging member are in contact, relative rotation of the rotation shaft about the axis thereof in the other direction with respect to the lever is restricted.

According to this constitution, when one engaging member and a corresponding one abutted face make contact, relative rotation of the rotation shaft about the axis thereof in one direction with respect to the lever is restricted. Also, when another engaging member and a corresponding other abutted face make contact, relative rotation of the rotation shaft about the axis thereof in the other direction with respect to the lever is restricted. For this reason, the lever and the rotation shaft enter a state of being positioned about the rotation axis. Here, the engaging members are provided in a manner each capable of advancing and retracting with respect to the lever. By such advancing and retracting, it is possible to adjust the position at which the distal end face makes contact with the corresponding abutted face, and thereby it is possible to accurately adjust the relative position of the lever and the rotation shaft about its axis. Also, even if torque acts from the rotation shaft to the lever, since axial force mainly acts from the abutted face to the distal end face at the engaging members that are provided in the lever, it is possible to firmly mount the lever on the rotation shaft even with small member dimensions.

The engaging member may be screwed into the lever; and by the rotation of the engaging member about the axis thereof, it may be capable of advancing toward and retracting from the abutted face that corresponds to the engaging member.

In this case, by screwing the engaging member into the lever, it is possible to mount the engaging member in the lever, and it is possible to accurately perform positional adjustment toward the outer peripheral surface of the rotation shaft by causing the engaging member to rotate about its axis. For this reason, it is possible to accurately adjust the relative position of the lever and the rotation shaft about the axis thereof, and possible to firmly fix them at the adjusted position.

The abutted face may be formed on a virtual plane that includes the center line of the rotation shaft and the engaging member may be capable of advancing toward and retracting from the virtual plane in a perpendicular direction.

In this case, since the abutted face is formed on a virtual plane that includes the center line of the rotation shaft, and the engaging member may be capable of advancing and retracting in a perpendicular direction, it is possible to make the engagement force between the engaging members and the rotation shaft act in a tangential direction about the axis of the rotation shaft. For this reason, it is possible to more firmly fix the lever to the rotation shaft.

The directions in which at least two of the engaging members mutually advance and retract may be approximately parallel.

In this case, it is possible to make the engagement force that acts on the abutted face of the rotation shaft act with sufficient balance from each of the two engaging members.

At least two of the engaging members may be arranged to be approximately symmetrical to a line that intersects with the center line of the rotation shaft.

In this case, it is possible to make the engagement force that acts on the abutted face of the rotation shaft act with sufficient balance from each of the two engaging members.

It may be further provided with a latch plate that is fixed to one of the lever and an end surface of the rotation shaft and a step portion that is provided in the other of the lever and the end surface of the rotation shaft, and in which a portion of the latch plate is fitted.

In this case, by the latch plate that is fixed to one of the lever and an end surface of the rotation shaft being fitted in the step portion that is provided in the other, it is possible to firmly fix the rotation shaft and the lever about the axis of the rotation shaft. Also, by the latch plate being fitted in the step portion, it is possible to perform rough positional alignment of the relative position of the lever and the rotation shaft about the axis, and possible to make position adjustment by advancing and retracting the engaging members easier.

The latch plate and the step portion are formed in arcuate shapes so that their shapes may mutually dovetail.

In this case, by the latch plate and the step portion being fit together by being formed in arcuate shapes so that their shapes may mutually dovetail, a force that acts between the lever and the rotation shaft can be made to act uniformly over the entire engagement plate and the step portion.

Also, the present invention is a method of mounting on a rotation shaft a lever that causes this rotation shaft to rotate, including an engaging member installation step that provides a plurality of engaging members in a lever in a manner capable of advancing and retracting so that, by causing the distal end faces of the plurality of engaging members to respectively abut the outer periphery of the rotation shaft, at least one of the plurality of engaging members restricts the rotation of the rotation shaft about the axis in one direction with respect to the lever, and at least one of the other of the plurality of engaging members restricts the rotation of the rotation shaft about the axis in the other direction with respect to the lever; a rotation shaft processing step that forms a plurality of abutted faces on the outer peripheral surface of the rotation shaft at positions where the distal end face of each engaging member abuts; and a position adjustment step that performs position adjustment by causing each of the engaging members to advance toward and retract from each of the abutted faces.

According to this method, by one engaging member that is formed in the engaging member installation step and one abutted face that is formed in the rotation shaft processing step making contact, relative rotation of the rotation shaft about the axis thereof in one direction with respect to the lever is restricted. Also, by another engaging member that is formed in the engaging member installation step and another abutted face that is formed in the rotation shaft processing step making contact, relative rotation of the rotation shaft about the axis thereof in the other direction with respect to the lever is restricted. Then, in the position adjustment step, by causing the plurality of engaging members to respectively advance toward and retract from the rotation shaft, it is possible to adjust the position at which the distal end face abuts the corresponding abutted face, and thereby it is possible to accurately adjust the relative position of the lever and the rotation shaft about the axis thereof. Also, even if the torque acts on the lever from the rotation shaft, since axial force mainly acts from the abutted face to the distal end face at the engaging member, it is possible to firmly attach the lever to the rotation shaft even with small member dimensions.

The engaging member installation step may cause the engaging members, which have a male screw, to be screwed into the lever, which has female screws.

In this case, in the engaging member installation step, the engaging members have a male screw, and by forming female screws in the lever and screwing them together, it is possible to firmly fix the engaging members to the lever. Also, in the position adjustment step, by causing the engaging members to rotate about their own axis, it is possible to accurately adjust their position toward the outer peripheral surface of the rotation shaft. For this reason, it is possible to accurately adjust the relative position of the lever and the rotation shaft about the axis, and it is possible to firmly fix them at the adjusted position.

Also, the fluid machine of the present invention is provided with a rotor; a cylindrical casing that is concentric with the rotor; a plurality of variable stator vanes that are arranged so as to extend from the inner periphery of the casing toward the rotor; the rotation shaft that penetrates from each of the variable stator vanes through the case to extend to the outer periphery of the casing; and a lever that causes this rotation shaft to rotate, in which the lever is fixed to the rotation shaft by the aforementioned mounting structure for a rotation shaft and a lever.

In this case, since the rotation shaft and the lever are mounted by the aforementioned mounting apparatus, it is possible to accurately adjust the position of the variable stator vanes in which rotation shafts are provided by operation of the lever, and after the position adjustment, the variable stator vane, the rotation shaft, and the lever are integrated, and so it is possible to securely maintain them at the adjusted position.

Effect of the Invention

According to the mounting structure for a rotation shaft and a lever of the present invention, due to the simple constitution of the engaging members that are provided in an advancing and retracting manner in the lever, and the abutted faces that are formed on the rotation shaft, it is possible to firmly fix the lever to the rotation shaft while being accurately positioned.

According the method of mounting a rotation shaft and a lever of the present invention, with the simple procedures to provide the engaging members in the lever in a manner capable of advancing and retracting, form the abutted faces on the rotation shaft, and adjust the positions of the engaging members by the engaging member installation step, the rotation shaft processing step, and the position adjustment step, it is possible to firmly fix the lever to the rotation shaft while being accurately positioned.

Also, according to the fluid machine of the present invention, since it is provided with the aforementioned mounting structure, it is possible to accurately maintain the position after adjustment while accurately adjusting the position of the variable stator vanes.

BEST MODE FOR CARRYING OUT THE INVENTION

Figure 1:
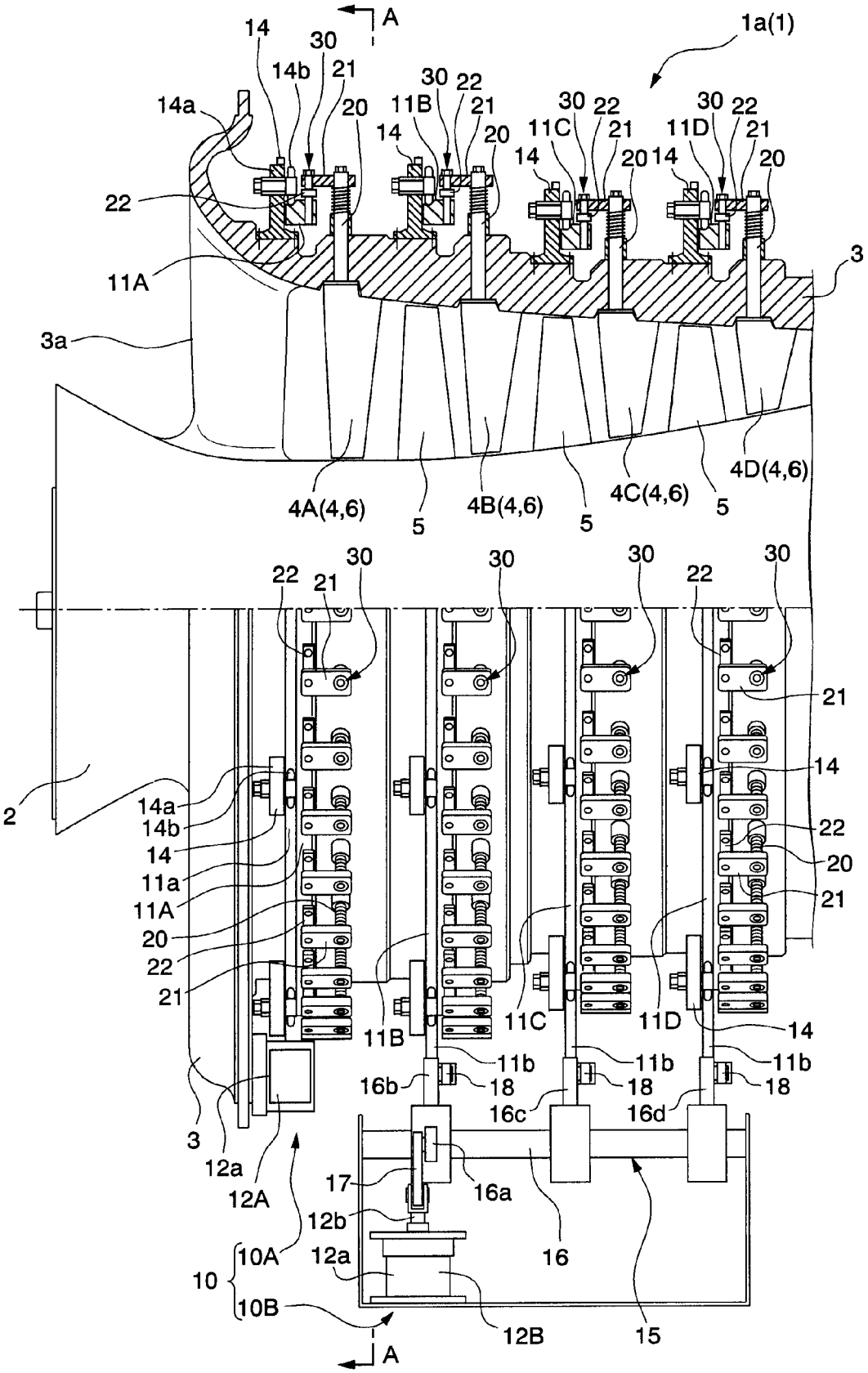
FIG. 1 is a half sectional view that shows a portion of a compressor in a gas turbine of the embodiment of the present invention.
Figure 2:
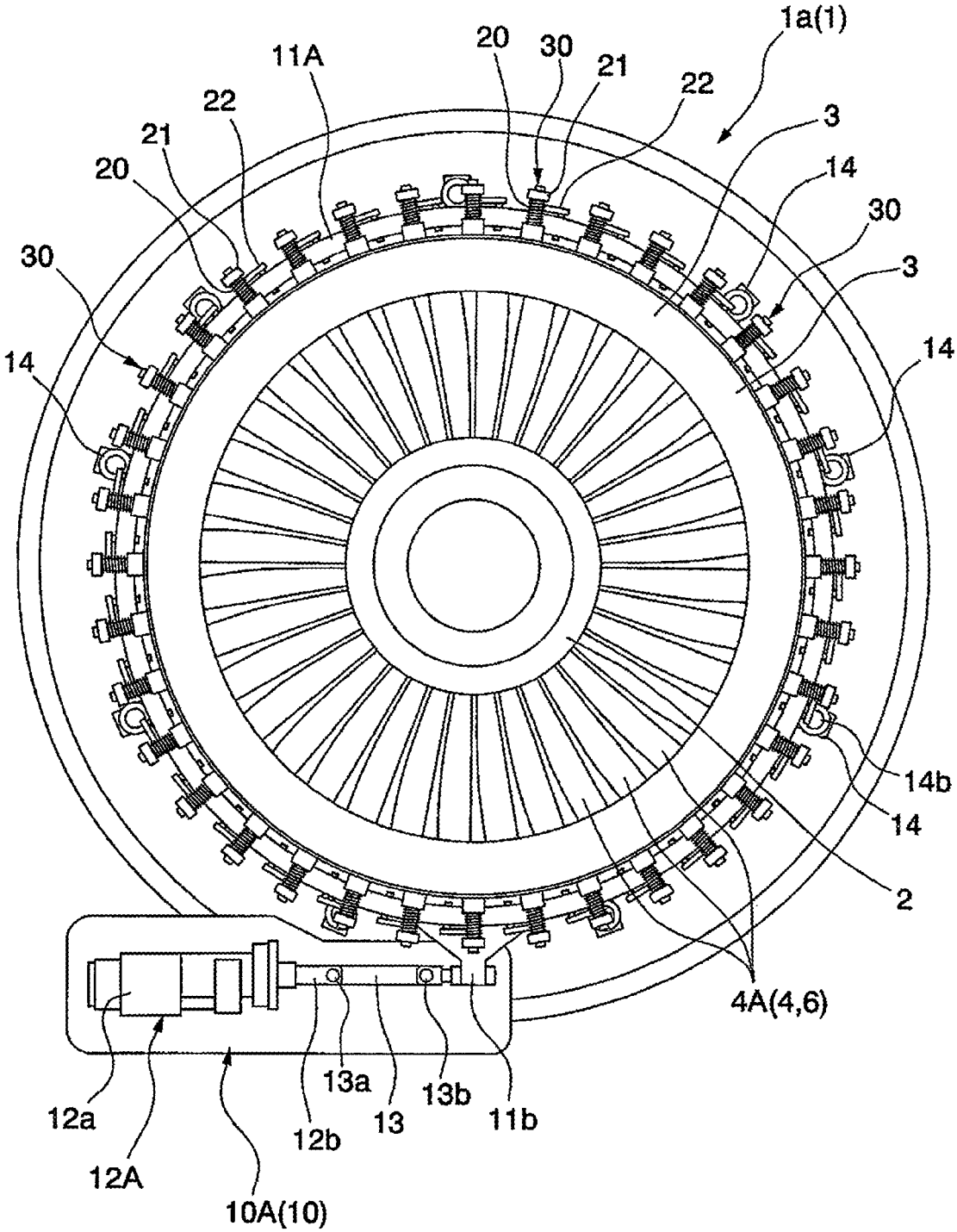
FIG. 2 is a sectional view at the section line A-A of FIG. 1.

Hereinbelow, the embodiment of the present invention shall be described with reference to FIG. 1 to FIG. 6. FIG. 1 and FIG. 2 show the constitution of a compressor 1*a* in a gas turbine 1 that is a fluid machine of the present embodiment, and is provided with a rotor 2 that is coupled with a turbine not illustrated, an approximately cylindrical casing 3 that surrounds the outer circumference of the rotor 2, stator vanes 4 that are provided inside of the casing 3, and rotor vanes 5 that are provided in the rotor 2. A plurality of the stator vanes 4 are arranged so as to extend from the inner periphery of the casing 3 towards the rotor 2. Also, a plurality of the rotor vanes 5 are arranged in a radial shape on the outer circumference of the rotor 2, and the base ends thereof are supported by the outer circumference of the rotor 2. Also, the respective arrangements of the stator vanes 4 and the rotor vanes 5 are constituted over a plurality of levels so as to alternate in the axial direction of the rotor 2. The rotation of the rotor vanes 5 with the rotor 2 compresses a fluid that flows from a suction portion 3*a* that is provided at one end side of the casing 3 through the inside where the plurality of the stator vanes 4 and the rotor vanes 5 are arranged, and supplies it to a combustor not illustrated.

Here, in the present embodiment, among the plurality of levels of the stator vanes 4, in the order from the furthest upstream side of the flow passage, a first stage stator vane (entrance guiding blade) 4A, a second stage stator vane 4B, a third stage stator vane 4C, and fourth stage stator vane 4D are variable stator vanes 6 whose respective angles can be adjusted. Each variable stator vane 6 is constituted to allow adjustment of its angle about its own axis by a driving apparatus 10 that is provided on the outer circumferential side of the casing 3. That is, at the base end of each variable stator vane 6, a rotation shaft 20 extends toward the outer circumferential side, and the rotation shaft 20 is supported in a rotatable manner by the casing 3, whereby it is possible to change the angle of each variable stator vane 6 while being supported by the casing 3. Also, the rotation shaft 20 extends to the outer circumferential side of the casing 3, and a lever 21 is mounted on a distal end portion 20*a* and projects in the radial direction of the rotation shaft 20. Then, by turning the lever 21 that is attached to each rotation shaft 20 a predetermined angle by the driving apparatus 10, it is possible to adjust the angle of the variable stator vane 6 that is connected with the rotation shaft 20.

As shown in FIG. 1 and FIG. 2, the driving apparatus 10 consists of a first driving apparatus 10A for adjusting the angle of the first-stage stator vane 4A, and a second driving apparatus 10B for adjusting the angles of the second- to fourth-stage stator vanes 4B to 4D. As shown in FIG. 1 and FIG. 2, the first driving apparatus 10A has a first driving ring 11A that is provided adjacent to the arrangement of the rotation shafts 20 of the first-stage stator vanes 4A, a first actuator 12A that causes the first driving ring 11A to rotate, and a coupling member 13 that couples the first actuator 12A and the first driving ring 11A.

A plurality of supporting members 14 that support the first driving ring 11A are provided in the circumferential direction at the outer circumferential side of the casing 3 at positions corresponding to the first driving ring 11A. The support portion 14 has a supporting member 14*a* that projects from the casing 3 and a roller 14*b* that is supported in a rotatable manner by the supporting member 14*a*. The roller 14*b* of each supporting portion 14 is fitted in and makes contact with a groove 11*a* that is formed in the circumferential direction of the outer circumferential surface of the first driving ring 11A, whereby the first driving ring 11A is supported in a rotatable manner in the state of having a gap with respect to the casing 3. Also, a link member 22 is connected in a rotatable manner between a distal end portion 21*a* of the lever 21 and the outer circumferential surface of the first driving ring 11A. Also, at the lower side of the outer circumferential surface of the first driving ring 11A, a mounting portion 11*b* that the coupling member 13 is coupled to projects to the outer circumferential side.

The first actuator 12A is, for example, a hydraulic cylinder, and has a cylinder body 12*a* and a rod 12*b* that moves forward and backward by driving of the cylinder body 12*a*. The rod 12*b* of the first actuator 12A is disposed to be capable of moving forward and backward toward the mounting portion 11*b* of the first driving ring 11A. Moreover, one end 13*a* of the coupling member 13 is mounted in a rotatable manner at the distal end of the rod 12*b* of the first actuator 12A, and the other end 13*b* is mounted in a rotatable manner on the mounting portion 11*b* of the first driving ring 11A. For this reason, by driving the first actuator 12A to make the rod 12*b* move forward or backward, it is possible to make the first driving ring 11A that is coupled via the coupling member 13 rotate by just a desired angle to one side or the other side about the axis of the rotor 2. Thereby, by rotating the rotation shaft 20 about its axis via the lever 21 that is attached to the first driving ring 11A, it is possible to adjust the angle of the first-stage stator vane 4A.

Figure 3:
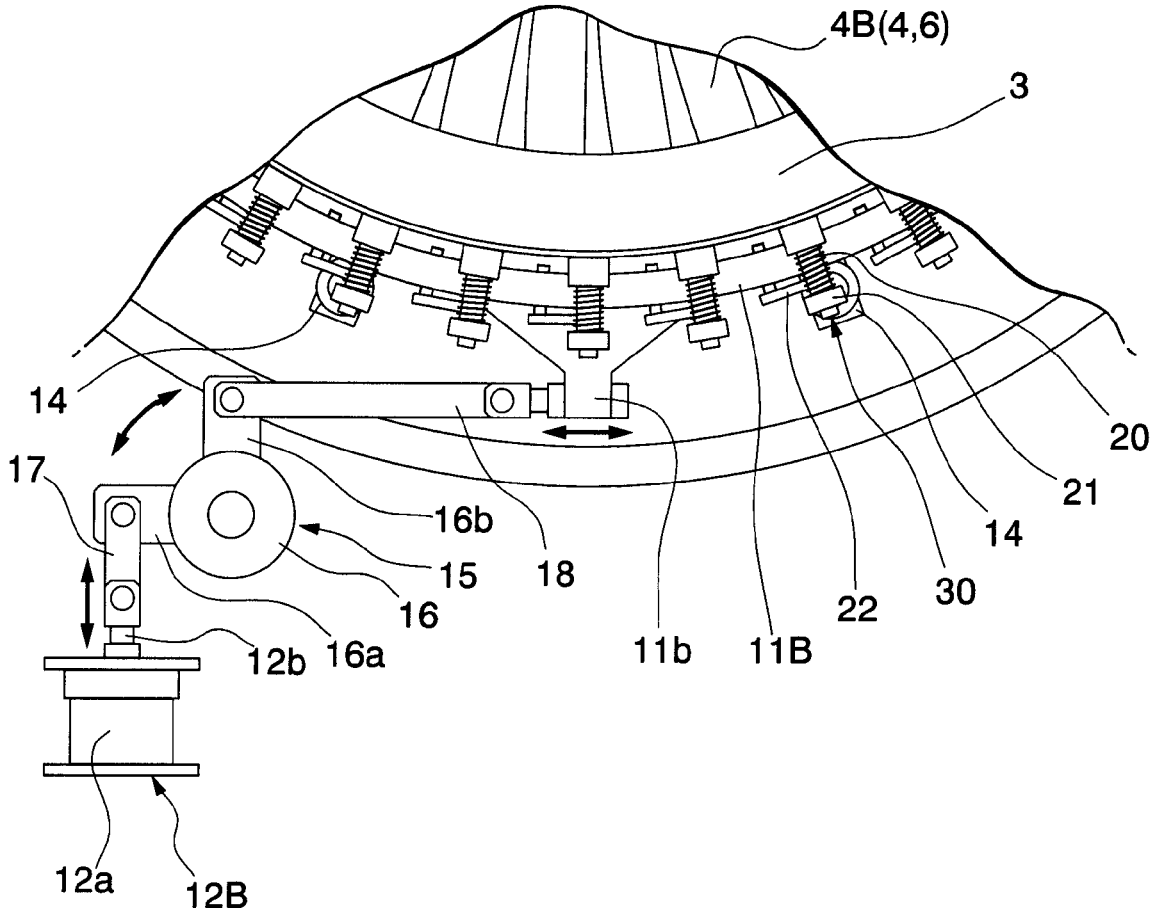
FIG. 3 is a detailed view of a second driving apparatus in the compressor of the embodiment of the present invention.

Also, as shown in FIG. 1 and FIG. 3, the second driving apparatus 10B has a second driving ring 11B, a third driving ring 11C, and a fourth driving ring 11D that are respectively provided adjacent to the arrangements of the rotation shafts 20 of the second- to fourth-stage stator vanes 4B to 4D, a second actuator 12B that causes the second driving ring 11B, the third driving ring 11C, and the fourth driving ring 11D to rotate, and a coupling mechanism 15 that couples the second actuator 12B and the second driving ring 11B, the third driving ring 11C, and the fourth driving ring 11D. The second driving ring 11B, the third driving ring 11C, and the fourth driving ring 11D are supported by the supporting portion 14 in a rotatable manner in the state of having a gap with respect to the casing 3. The link member 22 is connected in a rotatable manner between the distal end portion 21*a* of the lever 21 and the outer circumferential surface of the corresponding second driving ring 11B, third driving ring 11C, or fourth driving ring 11D, similarly to the case of the first driving ring 11A. Also, a mounting portion 11*b* that the coupling mechanism 15 is coupled to projects to the outer circumferential side at the lower side on the outer circumferential surface of each of the second driving ring 11B, the third driving ring 11C, and the fourth driving ring 11D.

Also, the second actuator 12B is, for example, a hydraulic cylinder, and has a cylinder body 12*a* and a rod 12*b* that moves forward and backward by driving of the cylinder body 12*a*. The coupling mechanism 15 has a driving shaft 16 that is arranged at a predetermined position in the axial direction of the rotor 2 along the arrangement of the second driving ring 11B, the third driving ring 11C, and the fourth driving ring 11D, and a driving side coupling member 17 and ring side coupling member 18 that couple the driving shaft 16 and the second actuator 12B, the second driving ring 11B, the third driving ring 11C, and the fourth driving ring 11D.

The driving shaft 16 is supported in a rotatable manner by the casing 3. Also, a driving arm 16*a* and ring coupling arms 16*b*, 16*c*, and 16*d* project out in the radial direction from the driving shaft 16 in correspondence with the second actuator 12B, the second driving ring 11B, the third driving ring 11C, and the fourth driving ring 11D, respectively.

One end of the driving side coupling member 17 is attached in a rotatable manner to the rod 12*b* of the second actuator 12B, and the other end is attached in a rotatable manner to the driving arm 16*a* of the driving shaft 16. For this reason, by moving the rod 12*b* of the second actuator 12B forward or backward, it is possible to make the driving shaft 16 rotate about its axis via the driving side coupling member 17 and the driving arm 16*a*. Also, one end of each ring side coupling member 18 is attached in a rotatable manner to the corresponding ring coupling arms 16*b*, 16*c*, and 16*d*, while the other end is attached in a rotatable manner to the mounting portion 11*b* of the corresponding second driving ring 11B, the third driving ring 11C, or the fourth driving ring 11D. For this reason, by causing the driving shaft 16 to rotate about its axis by the second actuator 12B, it is possible to make the second driving ring 11B, the third driving ring 11C, and the fourth driving ring 11D that are coupled to the driving shaft 16 via the ring coupling arms 16*b*, 16*c*, and 16*d* and the ring side coupling member 18 rotate by just a desired angle to one side or the other side about the axis of the rotor 2. Thereby, by causing the rotation shafts 20 to rotate via each lever 21 that is attached to the second driving ring 11B, the third driving ring 11C, and the fourth driving ring 11D, it is possible to adjust the angle of the second- to fourth-stage stator vanes 4B to 4D.

Next, a mounting structure 30 of the rotation shaft 20 and the lever 21 that are provided in the variable stator vane 6 shall be described in detail. Note that since each of the mounting structures 30 in the first- to fourth-stage stator vanes 4A to 4D basically have the same structure, hereinbelow only the mounting structure 30 of the rotation shaft 20 and the lever 21 in the first-stage stator vane 4A shall be described.

Figure 4:
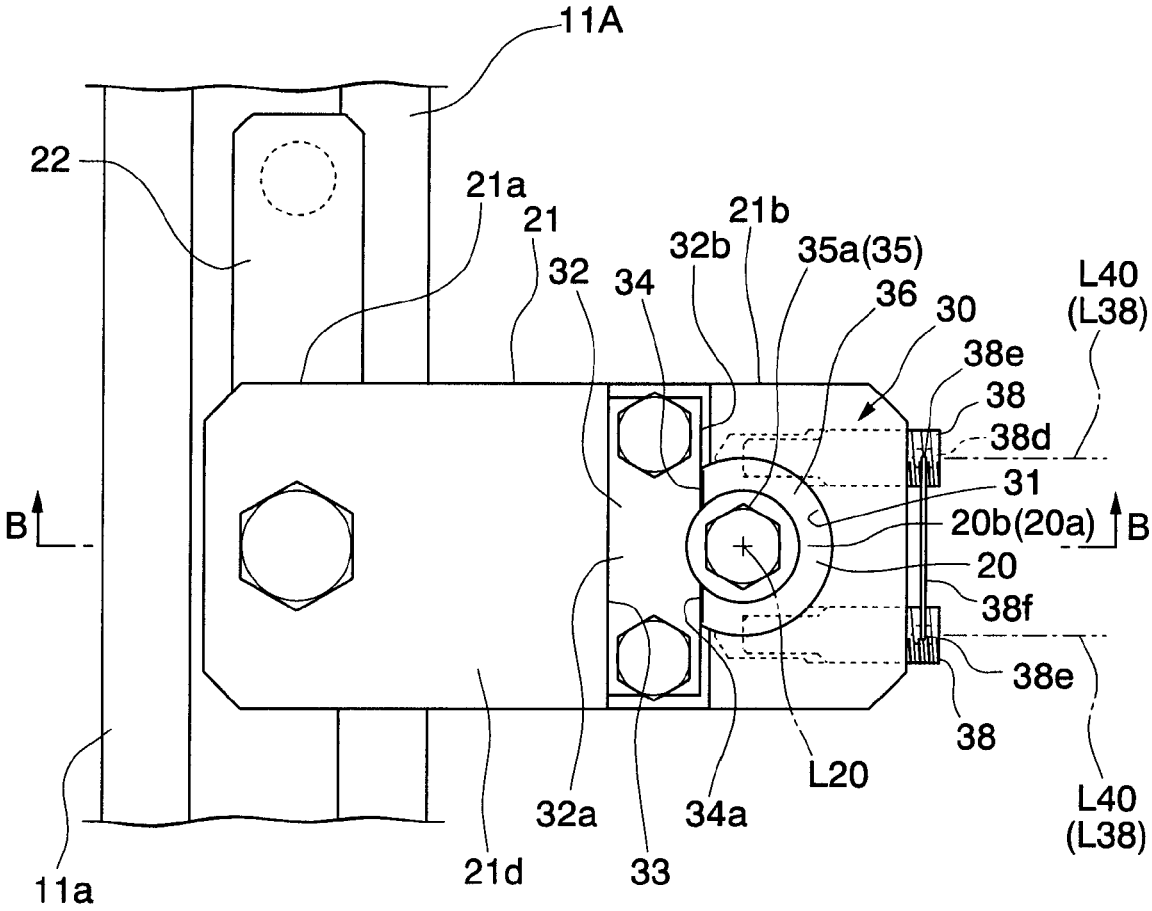
FIG. 4 is a front elevation of the mounting structure of the embodiment of the present invention.
Figure 5:
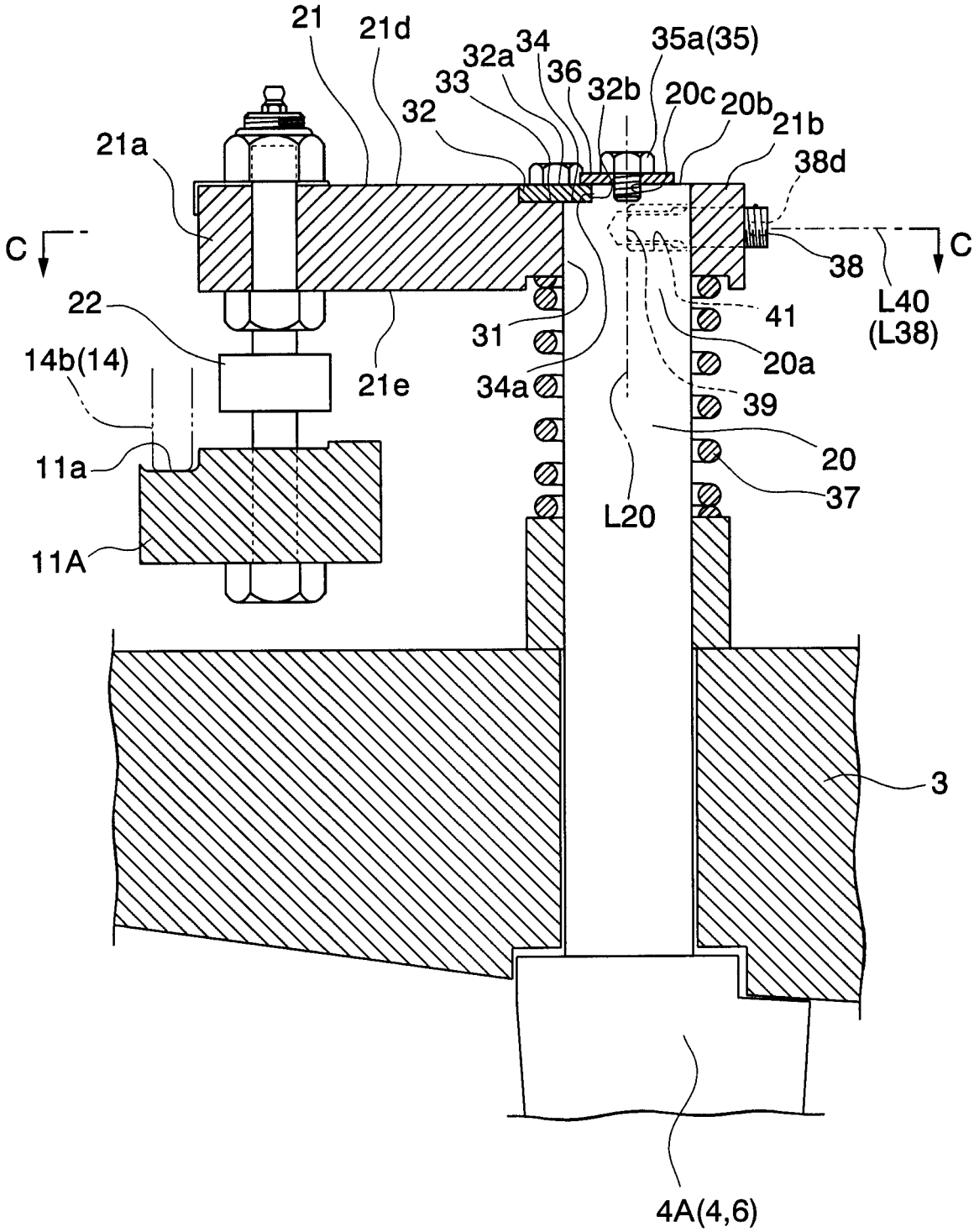
FIG. 5 is a sectional view at section line B-B of FIG. 4.
Figure 6:
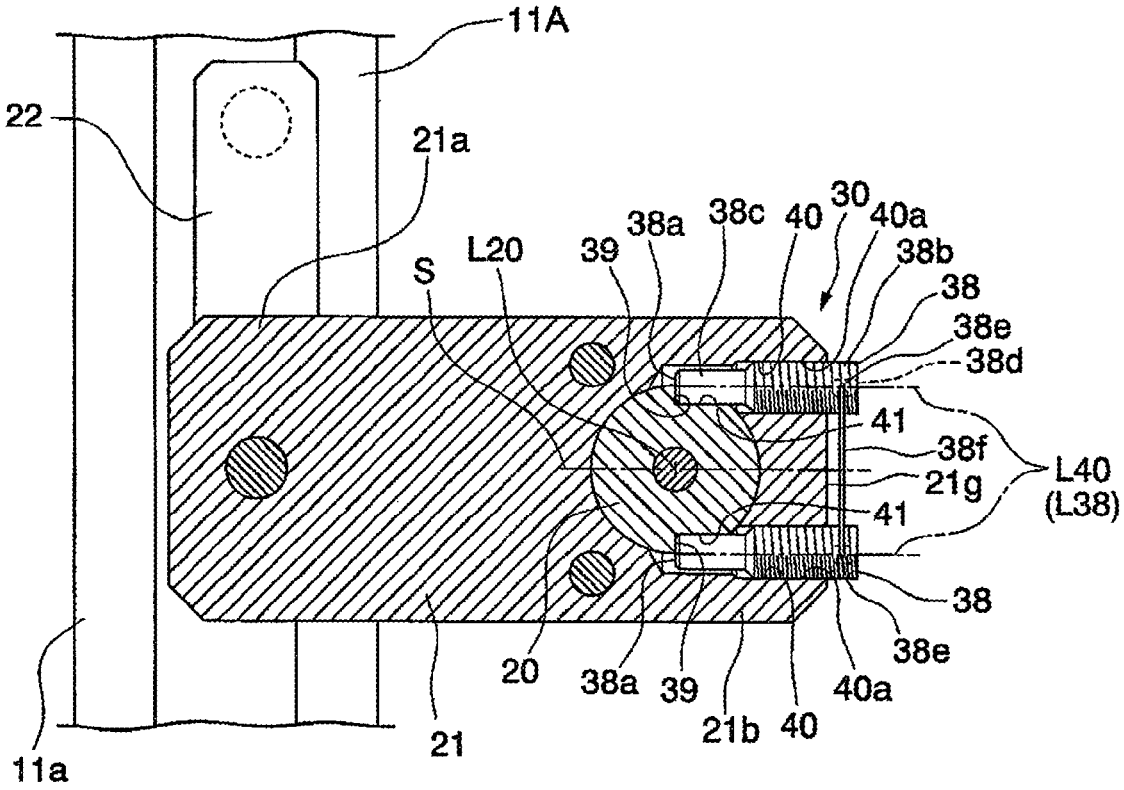
FIG. 6 is a sectional view at section line C-C of FIG. 5.

As shown in FIG. 4 to FIG. 6, the lever 21 is a long and thin, rectangular plate-shaped member, and a rotation shaft mounting hole 31 in which the distal end portion 20*a* of the rotation shaft 20 is fitted is formed at the base end portion 21*b*. Also, a latch plate 32 that traverses a portion of a distal end surface 20*b* of the rotation shaft 20 that is inserted in the rotation shaft mounting hole 31 is fixed by bolts to a one surface 21*d* on the opposite side of the side that the rotation shaft 20 is inserted in the rotation shaft mounting hole 31. Also, a housing groove 33 that the latch plate 32 is housed in is formed at the portion in the one surface 21*d* of the lever 21 where the latch plate 32 is mounted. The depth of the housing groove 33 is approximately equivalent to the thickness of the latch plate 32, and thereby the latch plate 32 is fixed so that a one surface 32*a* thereof is approximately flush with the one surface 21*d* of the lever 21.

Meanwhile, at the distal end surface 20*b* of the rotation shaft 20, a step portion 34 is formed so as to be lower than the rest of the distal end surface 20*b*, and a portion of the latch plate 32 that traverses the distal end surface 20*b* of the rotation shaft 20 is fitted therein. For this reason, the lever 21 is restricted by the latch plate 32 from shifting to the base end side with respect to the rotation shaft 20, and a state arises in which its own side surface 34*a* abuts a side surface 32*b* of the latch plate 32 in roughly aligned state. Also, a screw hole 20*c* is formed in the distal end surface 20*b* of the rotation shaft 20, and a fixing bolt 35 is screwed in. A washer 36 is interposed between a head portion 35*a* of the fixing bolt 35 and the distal end surface 20*b* of the rotation shaft 20. The outer diameter of the washer 36 is set to a size that abuts the latch plate 32 that is fitted in the step portion 34. For this reason, the washer 36 that is fixed to the rotation shaft 20 and the latch plate 32 that is fixed to the lever 21 latch together, and thereby the lever 21 is restricted from shifting more to the distal end side than the rotation shaft 20. That is, the rotation shaft 20 and the lever 21 enter a state of being fixed in the axial direction of the rotation shaft 20 by the latch plate 32 and the washer 36. Here, a spring 37 is sandwiched as a biasing means between the opposite side of the one surface 21*d* that the latch plate 32 is fixed to in the lever 21, that is, the other surface 21*e* in which the rotation shaft 20 is inserted, and the outer circumferential surface of the casing 3 that the rotation shaft 20 projects from, in a state of the rotation shaft 20 being inserted therethrough. For this reason, the lever 21 is biased to the distal end side of the rotation shaft 20 by the spring 37, whereby the one surface 21*d* enters a state of being pressed against the washer 36, and thereby the rotation shaft 20 and the lever 21 are mutually fixed in the axial direction without rattling.

Moreover, as shown in FIG. 4 to FIG. 6, two engaging members 38 that are capable of moving forward and backward toward/from the outer peripheral surface of the rotation shaft 20, so as to be offset from the center line L20 of the rotation shaft 20, are provided in the lever 21 as the mounting structure 30, and abutted faces 39 are provided corresponding to the engaging members 38 on the rotation shaft 20, and a distal end face 38*a* of the engaging member 38 mutually abuts the abutted face 39, whereby relative rotation of the rotation shaft 20 about the axis thereof with respect to the lever 21 is restricted.

That is, an engaging member mounting hole 40 that communicates with the rotation shaft mounting hole 31 is formed in the base end surface 21*g* of the lever 21. In the engaging member mounting hole 40, a female thread 40*a* is formed at the base end portion that opens to the base end surface 21*g* of the lever 21. The engaging member mounting holes 40 are in the present embodiment formed at positions tangent to the outer peripheral surface of the rotation shaft 20 that has a circular shape in cross section.

Moreover, in present embodiment, the engaging member mounting holes 40 are provided to form a pair, and are both formed to be approximately symmetrical with respect to the symmetry line S that intersects the center line L20 of the rotation shaft 20, and so that the center lines L40 thereof become mutually parallel.

Then, the engaging member 38 that has a screw portion 38*b* that is bar shaped and on which a male thread is formed, and a main body portion 38*c* that projects from the screw portion 38*b* to the rotation shaft 20 is screwed into each of the engaging member mounting holes 40. For this reason, the two engaging members 38 are arranged so as to be tangent to the outer peripheral surface of the rotation shaft 20 that is engaged in the rotation shaft mounting hole 31 by having their center lines L38 is approximately aligned with the center lines L40 of the engaging member mounting holes 40, and both are provided in the lever 21 to be approximately symmetrical with respect to the center line S that intersects with the center line L20 of the rotation shaft 20, and to be mutually parallel. Also, by rotating the engaging member 38 about its own axis, it is possible to make it advance or retract along a tangent to the outer peripheral surface of the rotation shaft 20 and thus perform positional adjustment with respect to the rotation shaft 20. Note that a hole 38*d* having a cross-sectional hexagonal shape is formed at the base end of the screw portion 38*b* of the engaging member 38, and so by inserting a hexagonal wrench in the hole 38*d*, it can be made to rotate about its axis.

In the distal end portion 20*a* of the rotation shaft 20, a notch portion 41 (concave portion) is formed in the range in which the main body portion 38*c* of the engaging member 38 interferes by the advance of the engaging member 38. The notch portion 41 (concave portion) is formed so as to open onto the outer circumferential surface of the distal end portion 20*a*, and the abutted face 39 is constituted by the surface that constitutes the notch portion 41 (concave portion). Here, the abutted face 39 is formed so as to continue with the outer circumferential surface as a portion of a virtual plane that includes the center line L20 of the rotation shaft 20. For that reason, the engaging member 38 is arranged at a predetermined position so that the center line L38 is a perpendicular direction with respect to the corresponding abutted face 39. Then, the distal end face 38*a* of one engaging member 38 correspondingly makes contact with one abutted face 39, whereby relative rotation of the rotation shaft 20 about the axis thereof to one side with respect to the lever 21 is restricted. Also, the distal end face 38*a* of the other engaging member 38 correspondingly makes contact with other abutted face 39, whereby relative rotation of the rotation shaft 20 about the axis thereof to the other side with respect to the lever 21 is restricted. For this reason, relative rotation of the rotation shaft 20 about the axis thereof in either direction with respect to the lever 21 is restricted by the engaging members 38 that are provided in the lever 21 and form a pair, that is, the rotation shaft 20 enters a state of being positioned about its axis. Also, a through-hole 38*e* is formed at the base end of the screw portion 38*b* of the engaging member 38, and the engaging members 38 that form a pair are tied together by a circular wire 38*f* that is inserted in the through-holes 38*e*.

Then, in such a mounting structure 30, while having a simple structure that has the engaging members 38 that are provided to be capable of advancing and retracting in the lever 21, and the abutted faces 39 that are formed on the rotation shaft 20, by adjusting the position at which the distal end face 38*a* abuts the corresponding abutted face 39 by the advancing or retracting of the engaging member 38, it is possible to accurately adjust the relative position of the lever 21 and the rotation shaft 20 about the axis thereof by rotating the rotation shaft 20 with respect to the lever 21. For this reason, it is possible to perform an adjustment so that the predetermined rotation position of the first driving ring 11A of the first driving apparatus 10A coincide with the predetermined angle of the variable stator vane 6 accurately, and thereby it is possible to accurately adjust the angle of the variable stator vane 6 via the lever 21 and the rotation shaft 20 in correspondence with rotation of the first driving ring 11A. Therefore, as the compressor 1*a*, it is possible obtain a stable output and improve the performance. In particular, as a result of the engaging members 38 being screwed into the engaging member mounting holes 40 of the lever 21, it is possible to easily and accurately perform positional adjustment toward the outer peripheral surface of the rotation shaft 20 by causing them to rotate about their own axes, and it is possible to more accurately adjust the relative position of the lever 21 and the rotation shaft 20 about its axis. Note that in the present embodiment, by tying the pair of engaging members 38 with the wire 38*f* that is passed through each through-hole 38*e*, they are restricted from independently rotating about their axis, and thereby shifting from their positioned state is reliably prevented.

Moreover, at the time of operation of the gas turbine 1, the variable stator vane 6 receives pressure from the fluid that flows through the flow passage, thereby torque acts on the rotation shaft 20, and the lever 21 that is mounted on the rotation shaft 20 needs to resist this torque. However, even if the torque acts on the lever 21 from the rotation shaft 20, since axial force mainly acts from the abutted face 39 to the distal end face 38*a* at the engaging member 38, it is possible to firmly attach the lever 21 to the rotation shaft 20 without any rattling even with small member dimensions. In particular, the engaging member 38 can be more firmly fixed to the lever 21 at the adjusted position by the engaging member 38 being screwed in the engaging member mounting hole 40 of the lever 21 as described above.

Moreover, the engaging members 38 are symmetrical to the symmetrical line S that intersects the center line L20 of the rotation shaft 20 as described above. Furthermore, the engaging members 38 that form a pair are disposed approximately parallel to each other. For this reason, it is possible to make the engagement force that acts on each abutted face 39 of the rotation shaft 20 act with sufficient balance from each of the two engaging members 38, and so it is possible to achieve a stable mounting state with the rotation shaft 20. Moreover, it is possible to make the engagement force between the engaging members 38 and the rotation shaft 20 act in a tangential direction about the axis of the rotation shaft 20 by the abutted faces 39 being formed as a portion of a virtual plane that includes the center line L20 of the rotation shaft 20, and the engaging members 38 advancing or retracting in a perpendicular direction thereto. For that reason, the lever 21 can be more firmly fixed to the rotation shaft 20. Moreover, in the present embodiment, the latch plate 32 that fixes the lever 21 and the rotation shaft 20 in the axial direction fits into the step 34 of the rotation shaft 20, and, thereby, they enter a state of the side surface of the latch plate 32 abutting and approximately aligned with the side surface of the step 34. For that reason, the relative rotation of the rotation shaft 20 with respect to the lever 21 is restricted by the latch plate 32, and it is possible to more firmly fix the rotation shaft 20 and the lever 21 about the axis of the rotation shaft 20.

Also, mounting of the rotation shaft 20 and the lever 21 by such a mounting structure 30 is performed by the procedure given below. First, the engaging member 38 is installed in the lever 21 in a manner capable of advancing or retracting as an engaging member installation step. That is, the engaging member mounting holes 40 are bored in the lever 21, and the female thread 40*a* is formed by screw cutting at the base end portion. Then, the engaging members 38 prepared beforehand are screwed in. Also, as the rotation shaft processing step, outer circumferential surface at the distal end portion 20*a* of the rotation shaft 20 is machined, and one surface thereof forms the notch portion 41 (concave portion) that serves as the abutted face 39.

Next, as a provisional assembly step, the distal end portion 20*a* of the rotation shaft 20 is fitted in the rotation shaft mounting hole 31 of the lever 21, the latch plate 32 is attached, and the washer 36 is fixed by the fixing bolt 35. Then, as the position adjustment step, in the state where the distal end portion 20*a* of the rotation shaft 20 has been fitted in the rotation shaft mounting hole 31 of the lever 21, by making each engaging member 38 advance or retract by causing it to rotate about its own axis to adjust the position at which the distal end face 38*a* thereof and the abutted face 39 of the rotation shaft 20 make contact, it is possible to accurately adjust the position of the rotation shaft 20 about its axis with respect to the lever 21, and firmly fix the adjusted position.

As described above, in the mounting method that adopts the mounting structure 30 of the present embodiment, it is possible to firmly fix while accurately positioning the lever 21 to the rotation shaft 20, and keep down costs involved with the mounting work by the aforementioned engaging member installation step, rotation shaft processing step, position adjustment step, providing the engaging members 38 in the lever 21 in a manner capable of advancing or retracting, forming the abutted faces 39 on the rotation shaft 20, and a simple procedure that adjusts the positions of the engaging members 38. Also, consequently, even in an existing gas turbine that has the driving apparatus 10 and variable stator vanes 6 in which rotation shafts 20 are provided, it is possible to easily apply the mounting structure 30 of the present embodiment. In particular, by adopting a constitution that provides the engaging member mounting holes 40 having the female screw 40*a* in the lever 21, and screwing in the engaging members 38, even in a constricted work environment where the surrounding structure serves as a hindrance in an existing installation, just by simply screwing in the engaging members 38, it is possible to easily install the engaging members 38. Also, even in the rotation shaft 20, since the abutted face 39 may be formed by the surface of the notch portion 41 (concave portion) by machining with an end mill or the like in correspondence with each engaging member 38, it is possible to easily form the abutted face 39. Also, in the present embodiment, in the provisional assembly step, by the fitting of the latch plate 32 in the step portion 34 of the rotation shaft 20, the side surface 32*b* abuts on and is roughly aligned with the side surface 34*a*. For that reason, the assembly of the rotation shaft and the lever 21 in the provisional assembly step is made easy, and the relative position about its axis of the rotation shaft 20 with respect to the lever 21 after performing the provisional assembly step is a roughly adjusted state, and since fine adjustment may be performed by the engaging members 38 in the position adjustment step, the mounting work becomes easier.

Figure 7:
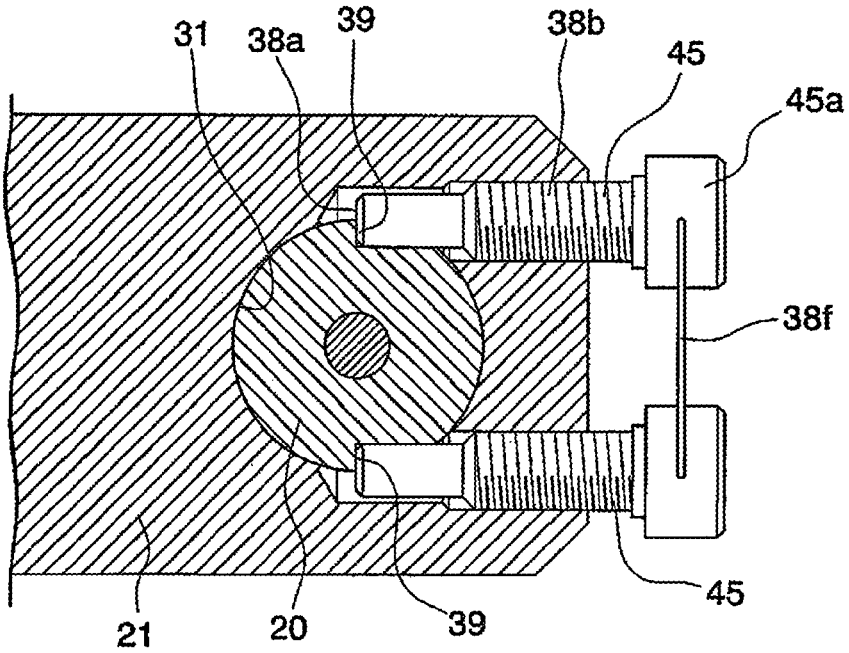
FIG. 7 is a sectional view seen from the front that shows the mounting apparatus of a first modification of the embodiment of the present invention.

Note that the aspect of the engaging member 38 is not limited to one that has a hexagonal hole 38*d* and that is tightened by a hexagonal wrench as described above, and an engaging member 45 that has a head portion 45*a* as in the first modification shown in FIG. 7 may be applied.

Figure 8:
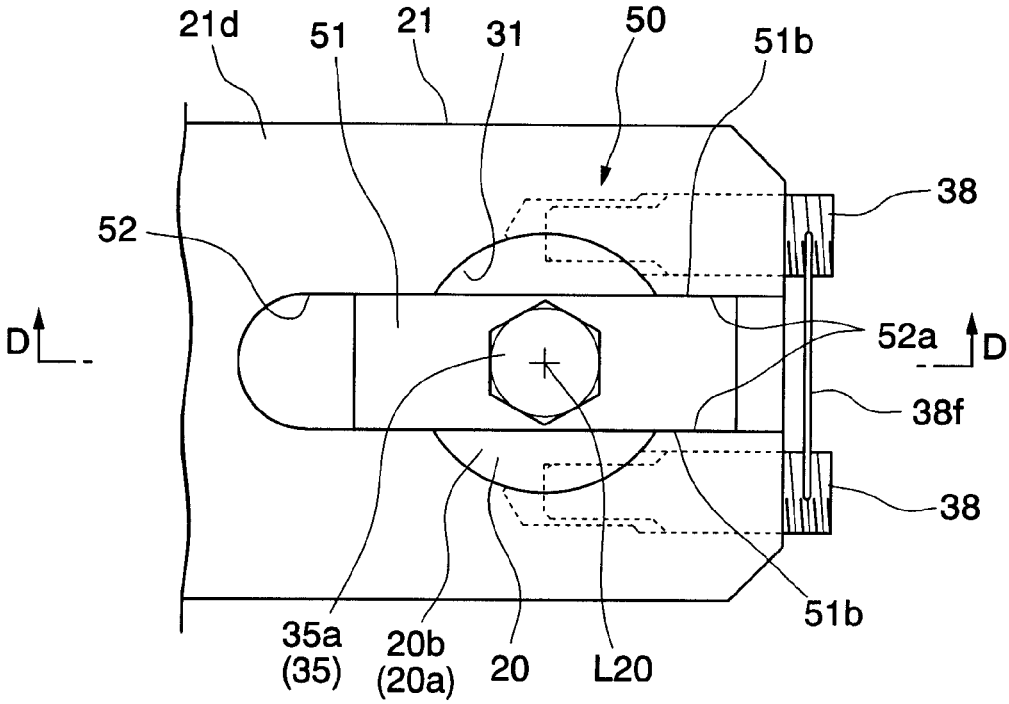
FIG. 8 is a front elevation that shows the mounting apparatus of a second modification of the embodiment of the present invention.
Figure 9:
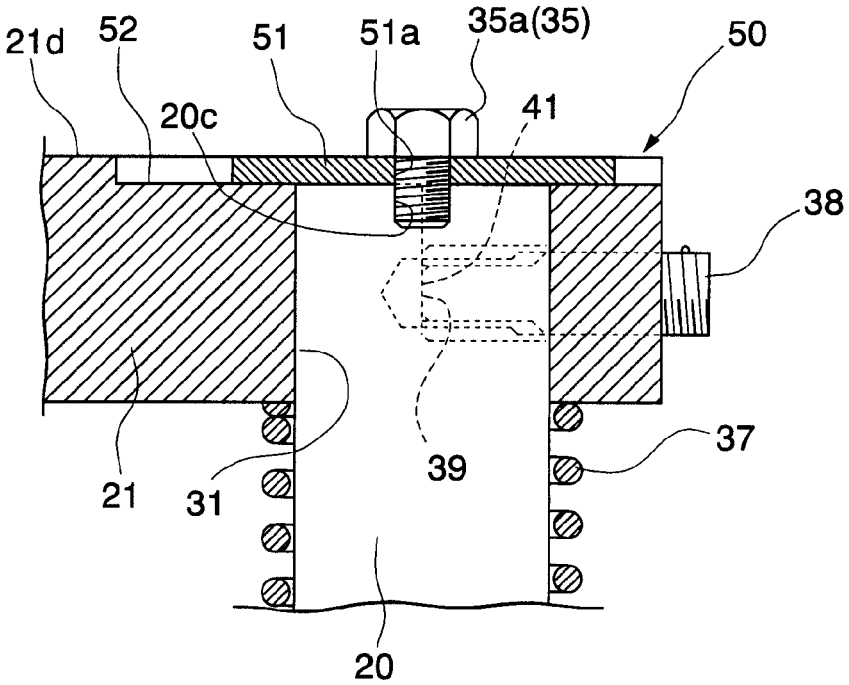
FIG. 9 is a sectional view at section line D-D of FIG. 8.

Moreover, FIG. 8 and FIG. 9 show the second modification. As shown in FIG. 8 and FIG. 9, in the mounting structure 50 of this modification, a latch plate 51 traverses the distal end surface 20*b* of the rotation shaft 20 so as to intersect with the centerline L20. An insertion hole 51*a* in which the fixing bolt 35 is inserted is formed in the latch plate 51, and the latch plate 51 is sandwiched between the head 35*a* of the fixing bolt 35 that was screwed into the screw hole 20*c* and the distal end surface 20*b* of the rotation shaft 20. Moreover, in the present embodiment, in the range where the latch plate 51 is fixed on the one surface 21*d* of the lever 21, a step portion 52 is formed so as to be lower than the rest of the one surface 21*d* of the lever 21, and so the latch plate 51 enters a state of being fitted into the step portion 52, and both side surfaces 51*b* of the latch plate 51 abuts on and is roughly aligned with both sides surfaces 52*a* of the step portion 52.

In the mounting structure 50 of this modification, by biasing the lever 21 by the spring 37 at the distal end side, to press the lever 21 against the latch plate 51, the rotation shaft 20 and the lever 21 are fixed without rattling in the axial direction of the rotation shaft 20. Also, with the latch plate 51 fitted in the step portion 52 formed in the lever 21, and both side surfaces 51*b* and 52*a* abut on and are aligned with each other, it is possible to roughly align the relative position about its axis of the rotation shaft 20 with respect to the lever 21, and it is possible to more firmly fix it about its axis in the aligned state.

Figure 10:
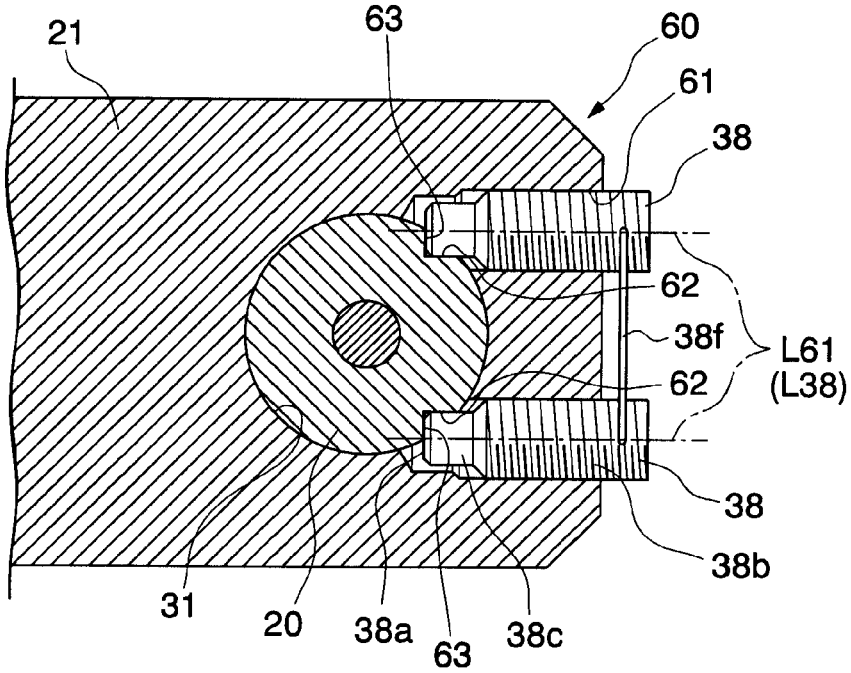
FIG. 10 is a sectional view seen from the front that shows the mounting apparatus of a third modification of the embodiment of the present invention.

FIG. 10 shows the third modification. As shown in FIG. 10, in a mounting structure 60 of this modification, a center line L61 of the engaging member mounting holes 61 in which the pair of engaging members 38 are screwed is not in alignment with a tangent to the outer peripheral surface of the rotation shaft 20. Also, an abutted face 63 that is formed by a notch portion 62 (concave portion) that is provided in the rotation shaft 20 is not aligned with the virtual plane that includes the center line L20 of the rotation shaft 20.

Even in the mounting structure 60 as in the present embodiment, one of the engaging members 38 that form a pair abuts one of the abutted faces 63 that is formed on the rotation shaft 20, whereby relative rotation of the rotation shaft 20 about the axis thereof to one side with respect to the lever 21 is restricted, and the other of the engaging members 38 abuts the other of the abutted faces 63 that are formed on the rotation shaft 20, whereby relative rotation of the rotation shaft 20 about the axis thereof to the other side with respect to the lever 21 is restricted. For this reason, it is possible to accurately position the rotation shaft 20 about the axis thereof with respect to the lever 21, and firmly fix it.

Figure 11:
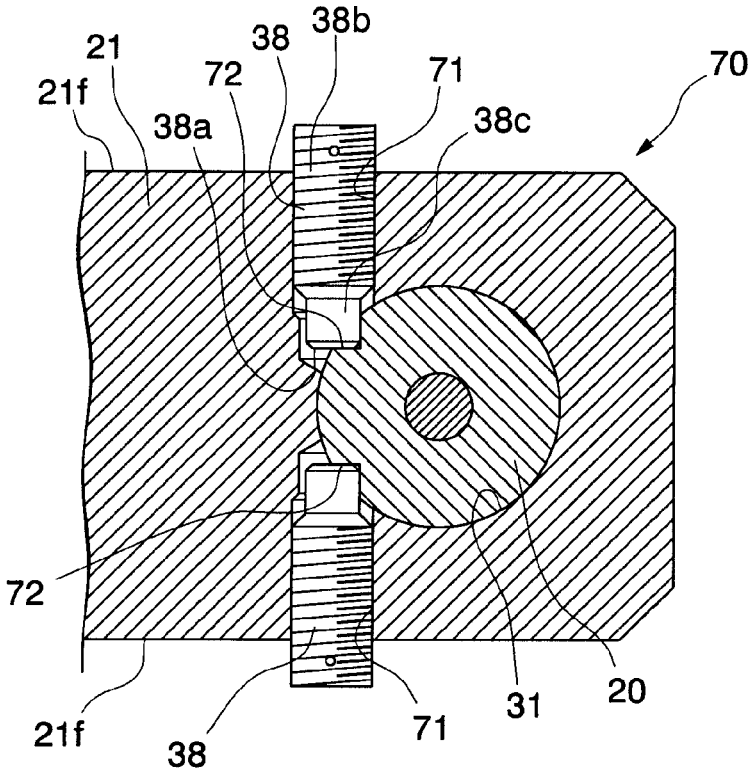
FIG. 11 is a sectional view seen from the front that shows the mounting apparatus of a fourth modification of the embodiment of the present invention.

FIG. 11 shows the fourth modification. As shown in FIG. 11, in the mounting structure 70 of this modification, engaging member mounting holes 71 that respectively mount the engaging members 38 that form a pair are formed in both side surfaces 21*f* of the lever 21 so as to mutually oppose each other. For this reason, there is a constitution in which both engaging members 38 advance toward and retract from each other. Even by adopting such a constitution, the engaging members 38 that form a pair are capable of advancing and retracting so as to shift from the center line L20 of the rotation shaft 20, whereby one of the engaging members 38 abuts one of the abutted faces 72 that is formed on the rotation shaft 20 to restrict relative rotation of the rotation shaft 20 to one side about its axis with respect to the lever 21, and the other of the engaging members 38 abuts the other of the abutted faces 72 that is formed on the rotation shaft 20 to restrict relative rotation of the rotation shaft 20 to the other side about its axis with respect to the lever 21, and thereby it is possible to position the lever 21 and the rotation shaft 20 about its axis, and firmly fix it in the positioned state. Also, in the present embodiment, the engagement force that acts on the rotation shaft 20 from the engaging members 38 that form a pair offset each other, and so it is possible to prevent an unbalanced load acting from the rotation shaft 20 on a portion of the inner peripheral surface of the rotation shaft mounting hole 31 of the lever 21.

Figure 12:
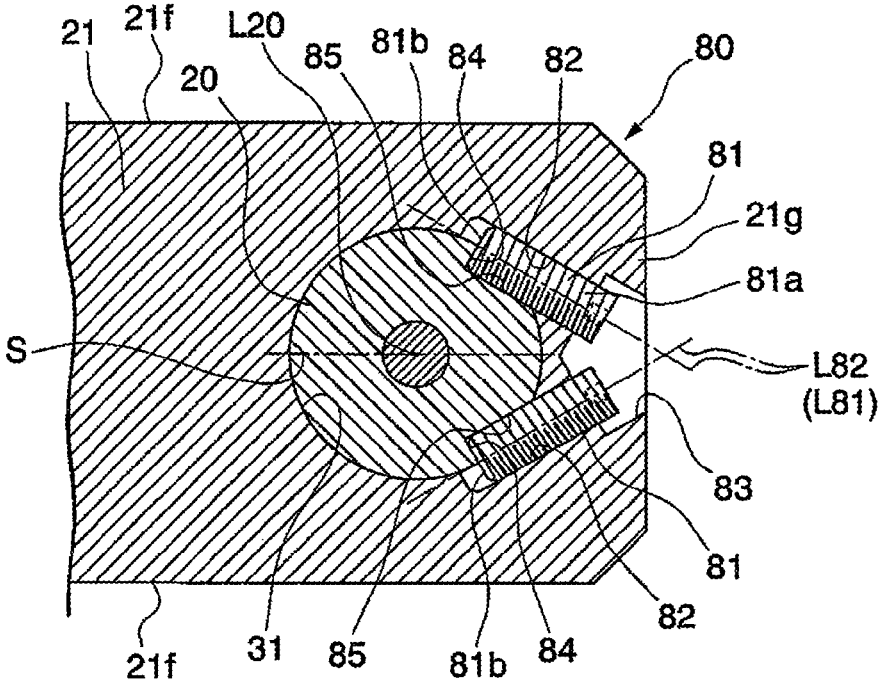
FIG. 12 is a sectional view seen from the front that shows the mounting apparatus of a fifth modification of the embodiment of the present invention.

FIG. 12 shows the fifth modification. As shown in FIG. 12, the mounting structure 80 of this modification is constituted so that engaging member mounting holes 82 in which engaging members 81 are screwed are formed so as to gradually diverge from the center portion of the base end surface 21*g* of the lever 21 to both side surfaces 21*f* mutually, and so do not become mutually parallel. At the same time, the engaging member mounting holes 82 that form a pair are provided in a symmetrical manner with respect to the symmetry line S that intersects with the center line L20 of the rotation shaft 20, and so the center lines L82 thereof are tangent to the outer peripheral surface of the rotation shaft 20. Also, both engaging member mounting holes 82 are formed from inside a concavity 83 that is formed in the center portion of the base end surface 21*g* so as not to interfere with each other, and open to the rotation shaft mounting hole 31.

Moreover, in the present embodiment, a male screw 81*a* is formed on the entire engaging member 81, which is screwed together with each engaging member mounting hole 82. For this reason, the engaging members 81 that form a pair are provided approximately symmetrical with respect to the center line S that intersects with the center line L20 of the rotation shaft 20, and so the center lines L82 thereof are tangent to the outer peripheral surface of the rotation shaft 20. Also, the abutted face 84 that the distal end face 81*b* of each engaging member 81 abuts is formed in the rotation shaft 20 by providing a notch portion 85 (concave portion) in the rotation shaft 20.

The abutted faces 84 are formed as a portion of a virtual plane that includes the center line L20 of the rotation shaft 20, and the engaging members 81 are arranged at predetermined positions so as to be perpendicular to the abutted faces 84.

In the mounting structure 80 of this modification, the engaging members 81 form a pair and are approximately symmetrical to the symmetry line S that intersects with the center line L20 of the rotation shaft 20. For this reason, it is possible to make the engagement force that acts on each abutted face 84 of the rotation shaft 20 act with sufficient balance from each of the two engaging members 81, and so it is possible to achieve a stable mounting state with the rotation shaft 20. Moreover, it is possible to make the engagement force between the engaging members 81 and the rotation shaft 20 act in a tangential direction about the axis of the rotation shaft 20 by the abutted faces 84 being formed as a portion of a virtual plane that includes the center line L20 of the rotation shaft 20, and the engaging members 38 advancing or retracting in a perpendicular direction thereto. For that reason, it is possible to more firmly fix the lever 21 to the rotation shaft 20.

Figure 13:
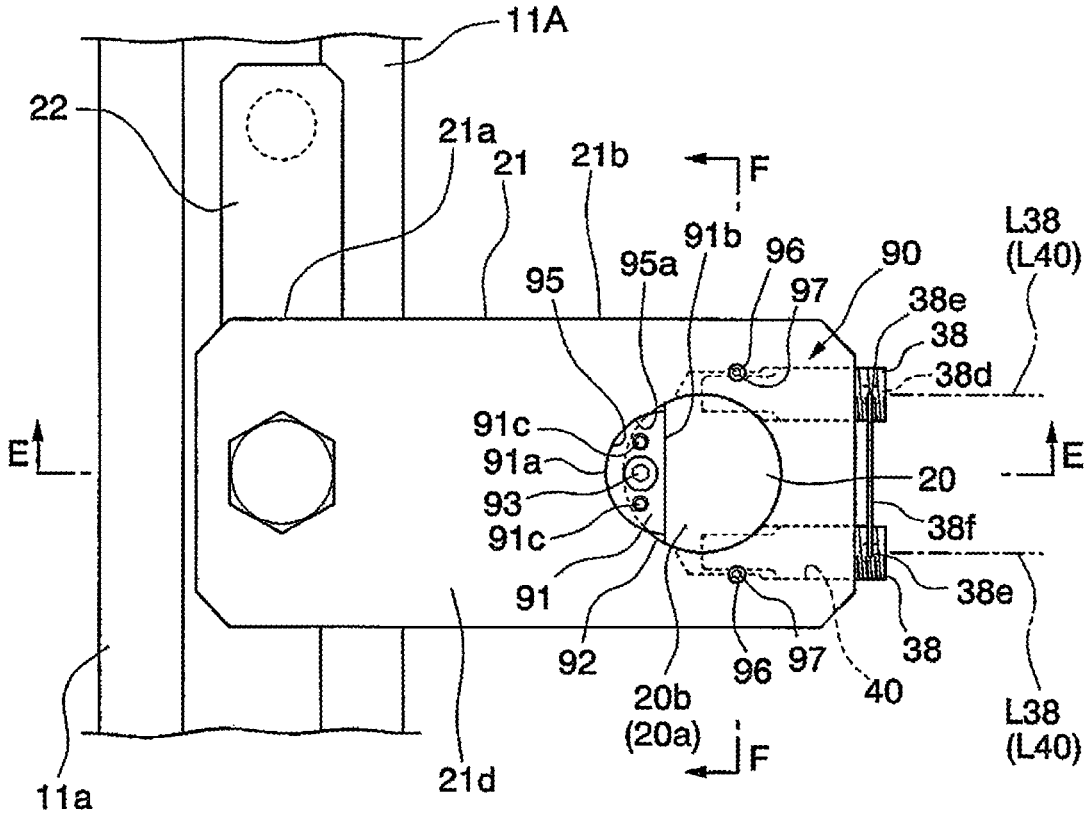
FIG. 13 is a front elevational view of the mounting apparatus of a sixth modification of the embodiment of the present invention.
Figure 14:
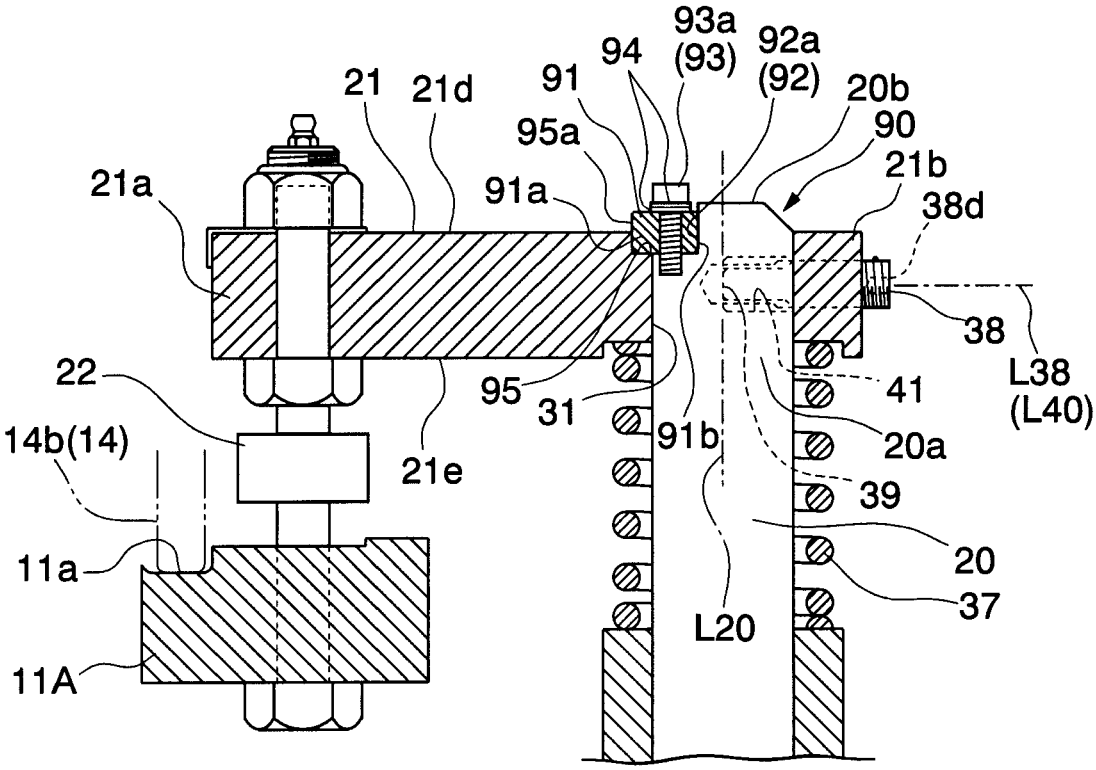
FIG. 14 is a sectional view at section line E-E of FIG. 13.
Figure 15:
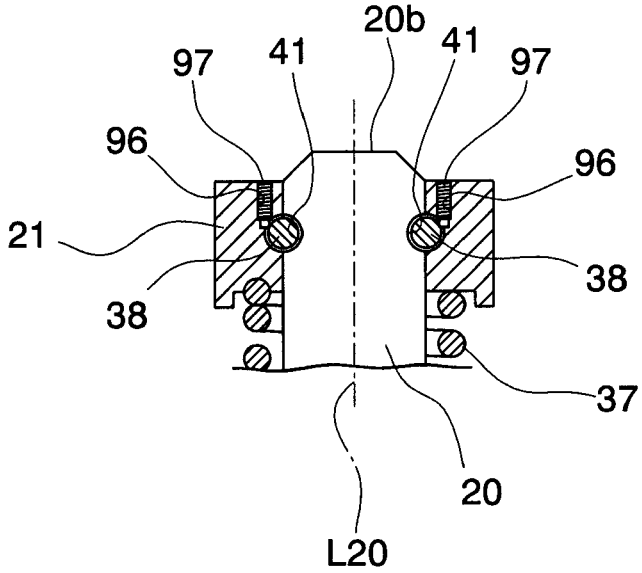
FIG. 15 is a sectional view at section line F-F of FIG. 13.
Figure 16:
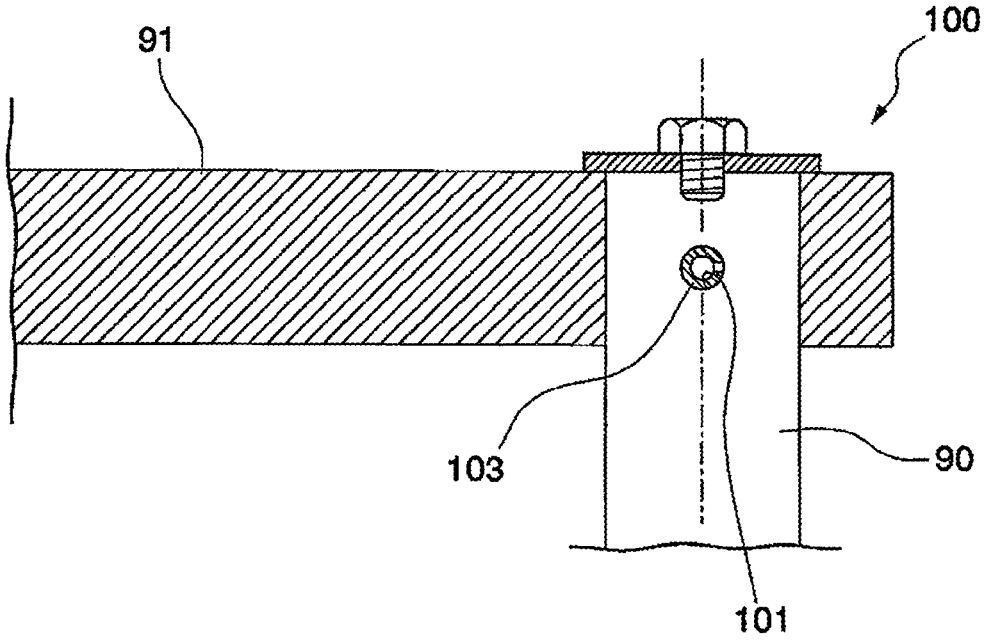
FIG. 16 is a sectional view seen from the side that shows a conventional mounting apparatus.
Figure 17:
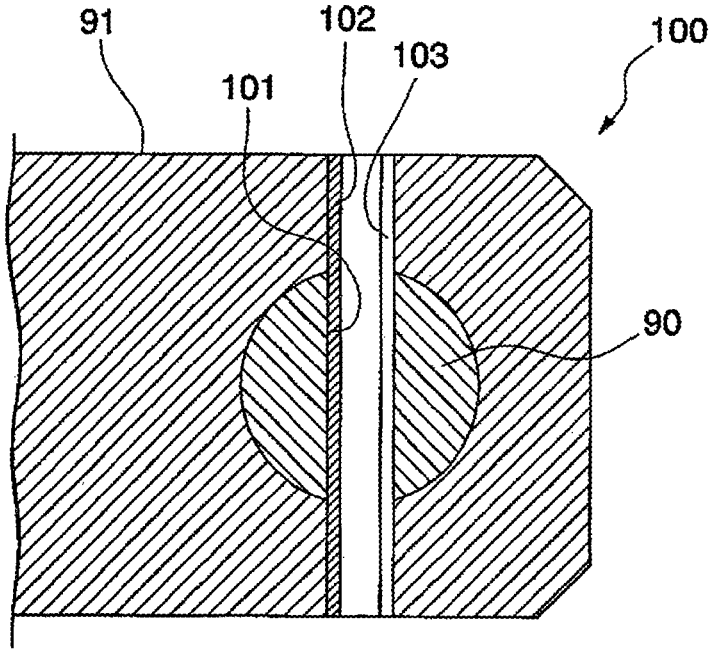
FIG. 17 is a sectional view seen from the front that shows a conventional mounting apparatus.

FIG. 13 to FIG. 15 show a sixth modification. As shown in FIG. 13 to FIG. 15, in a mounting structure 90 of this modification, an engagement plate 91 is fixed to the rotation shaft 20. The engagement plate 91 is particularly formed in a semicircular plate shape in the present embodiment, and has a curved surface portion 91*a* that is formed in a circular shape in planar view, and a plane portion 91*b* that is formed in a linear fashion. In contrast, a notch portion 92 (concave portion) is formed in an end surface 20*b* of the rotation shaft 20. Then, the engagement plate 91 is fixed by a fixing screw 93 that passes through the rotation shaft 20 from the engagement plate 91, and a pair of washers 94, 94 that are sandwiched between the head 93*a* of the fixing screw 93 and the engagement plate 91, so that the plane portion 91*b* abuts the side surface 92*a* of the notch portion 92 (concave portion) of the rotation shaft 20, and a portion of the curved surface portion 91*a* projects out to the lever 21 side. Here, irregularities are formed on both surfaces of the washer 94, and so by meshing together locking of the fixing screw 93 is performed.

Moreover, an arcuate-shaped step portion 95 is formed in the lever 21 with which a portion of the engagement plate 91 that projects from the rotation shaft 20 engages. In a planar view, a side surface 95*a* of the step portion 95 is formed as a curved surface with a circular arc having a curvature that corresponds to the curved surface portion 91*a* of the engagement plate 91, and so the side surface 95*a* abuts the curved surface portion 91*a* mutually.

Note that screw holes 91*c* that are open for free passage above and below are formed in the engagement plate 91, and a portion of the bottom surface of the notch portion 92 (concave portion) of the rotation shaft 20 is exposed. Also, a screw hole 96 that communicates with the engaging member mounting hole 40 is formed in the one surface of the lever 21. Then, an anti-loose screw 97 is screwed into the screw hole 96, and the distal end thereof abuts the engaging member 38 that has been screwed into the engaging member mounting hole 40, and thereby the engaging member 38 is restricted from advancing or retracting.

In the mounting structure 90 of this modification, the engagement plate 91 fits into the step portion 95 that is correspondingly formed in the lever 21, whereby relative rotation of the rotation shaft 20 with respect to the lever 21 is restricted. Here, the engagement plate 91 is formed in an arcuate shape, and the step portion 95 is correspondingly formed in an arcuate shape, and so since their curved surfaces abut, a force that acts between the lever 21 and the rotation shaft 20 can be made to act uniformly over the entire engagement plate 91 and the step portion 95.

For this reason, it is possible to prevent a so-called meshed state from occurring due to a stress concentration occurring at a portion between the engagement plate 91 and the step portion 95. Also, since the step portion 95 is formed with an arcuate shape, when processing with a milling machine or the like, processing of corner portions is unnecessary, and so the machining is easy. Moreover, in the present embodiment, since the side surface 95*a* of the step portion 95 is formed in a circular shape, it is possible to form just by a single boring process with a drill press or the like, and so it is possible to further simplify the processing. Also, the screw holes 91*c* are open for free passage above and below in the engagement plate 91 of the present embodiment. For this reason, even if the engagement plate 91 and the step portion 95 become meshed together, by screwing a screw into the screw hole 91*c* and causing the distal end to press against the bottom surface of the notch portion 92 (concave portion) of the rotation shaft 20, it is possible to easily release the meshed state.

Hereinabove, the embodiment of the present invention was described in detail with reference to the drawings, but specific constitutions are not limited to this embodiment, and design modifications within a scope that does not depart from the gist of the present invention are included.

Note that in the aforementioned embodiment and modifications thereof, all of the engaging members and abutted faces were provided as pairs, but are not limited thereto. A plurality of engaging members may be provided in the lever 21, and a plurality of abutted faces that respectively correspond with each engaging member may be formed on the rotation shaft 20, and a setting may be performed so that the relative rotation of the rotation shaft 20 about the axis thereof to one side with respect to the lever 21 is restricted by the abutting of at least one engaging member and a corresponding abutted face, and the relative rotation of the rotation shaft 20 about the axis thereof to the other side with respect to the lever 21 is restricted by the abutting of another engaging member and the another abutted face.

Also, the mounting structure according to the aforementioned embodiment and the modifications was described as one that is applied to a variable stator vane 6 in a compressor 1*a*, but they are not limited thereto. For example, they may be applied to various fluid machines that have blade structures, such as variable stator vanes in turbines, and moreover, if mounting a rotation shaft for which positional adjustment is performed about the axis thereof, and a lever that is rotated about the rotation shaft, they can be favorably applied to various ones without being limited to the blade structure portion of a fluid machine.

INDUSTRIAL APPLICABILITY

The present invention can be applied to various fluid machines that have a blade structure, such as variable stator vanes in a compressor or variable stator vanes in a turbine. Moreover, in the case of mounting a rotation shaft in which position adjustment about the axis is performed and a lever that causes the rotation shaft to rotate about the axis thereof, it can be favorably applied to various ones without being limited to a blade structure such as a fluid machine.

DESCRIPTION OF REFERENCE NUMERALS

1*a* compressor (rotating machine)
2 rotor
6 variable stator vane
20 rotation shaft
21 lever
30, 50, 60, 70, 80 mounting structure
32, 51 latch plate
34, 52 step portion
38, 45, 81 engaging member
39, 63, 72, 84 abutted face

The invention claimed is:

1. A mounting structure that mounts to a rotation shaft and a lever that causes this rotation shaft to rotate, comprising:

a plurality of engaging members that are provided in the lever so as to be offset from the center axis of the rotation shaft, and that are capable of advancing toward and retracting from the outer periphery of the rotation shaft a plurality of abutted faces that are provided on the outer periphery of the rotation shaft so that the distal end faces of the plurality of engaging members respectively make contact;

a latch plate that is fixed to one of the lever and an end surface of the rotation shaft; and a step portion that is provided in the other of the lever and the end surface of the rotation shaft, and in which a portion of the latch plate is fitted, wherein, when at least one of the engaging members and the abutted face that corresponds to that engaging member are in contact, relative rotation of the rotation shaft about the axis thereof in one direction with respect to the lever is restricted, and when another engaging member and another abutted face corresponding to the engaging member are in contact, relative rotation of the rotation shaft about the axis thereof in the other direction with respect to the lever is restricted.

2. The mounting structure for a rotation shaft and a lever according to claim 1, wherein the engaging members are screwed into the lever; and by the rotation of the engaging members about their axes thereof, they are capable of advancing toward and retracting from the abutted faces that correspond to the engaging members.

3. The mounting structure for a rotation shaft and a lever according to claim 1, wherein the abutted faces are formed on a virtual plane that includes the center line of the rotation shaft; and the engaging members are capable of advancing toward and retracting from the virtual plane in a perpendicular direction.

4. The mounting structure for a rotation shaft and a lever according to claim 1, wherein the directions in which at least two of the engaging members mutually advance and retract are approximately parallel.

5. The mounting structure for a rotation shaft and a lever according to claim 1, wherein at least two of the engaging members are arranged to be approximately symmetrical to a line that intersects with the center line of the rotation shaft.

6. The mounting structure for a rotation shaft and a lever according to claim 1, wherein the latch plate and the step portion are formed in arcuate shapes so that their shapes mutually dovetail.

7. A fluid machine in which a rotation shaft and a lever are mounted by the mounting structure for a rotation shaft and a lever according to claim 1, comprising:

a rotor;

a cylindrical casing that is concentric with the rotor;

a plurality of variable stator vanes that are arranged so as to extend from the inner periphery of the casing toward the rotor;

the rotation shaft that penetrates from each of the variable stator vanes through the case to extend to the outer periphery of the casing; and the lever that causes this rotation shaft to rotate.

8. A method of mounting on a rotation shaft a lever that causes this rotation shaft to rotate, comprising;

an engaging member installation step that provides a plurality of engaging members in a lever in a manner capable of advancing and retracting so that, by causing the distal end faces of the plurality of engaging members to respectively abut the outer periphery of the rotation shaft, at least one of the plurality of engaging members restricts the rotation of the rotation shaft about the axis in one direction with respect to the lever, and at least one of the other of the plurality of engaging members restricts the rotation of the rotation shaft about the axis in the other direction with respect to the lever;

a rotation shaft processing step that forms a plurality of abutted faces on the outer peripheral surface of the rotation shaft at positions where the distal end face of each engaging member abuts a position adjustment step that performs position adjustment by causing each of the engaging members to advance toward and retract from each of the abutted faces;

a latch plate processing step that forms a latch plate being fixed to one of the lever and an end surface of the rotation shaft; and a step portion processing step that forms a step portion being provided in the other of the lever and the end surface of the rotation shaft, and in which a portion of the latch plate is fitted.

9. The method of mounting a rotation shaft and a lever according to claim 8, wherein the engaging member installation step causes the engaging members, which have a male screw, to be screwed into the lever, which has female screws.

* * * * *